US007845634B2

(12) United States Patent
Asakawa et al.

(10) Patent No.: US 7,845,634 B2
(45) Date of Patent: Dec. 7, 2010

(54) PAPER DELIVERY MECHANISM AND APPARATUS FOR IMAGE FORMATION WITH A PAPER DELIVERY MECHANISM

(75) Inventors: Masaya Asakawa, Nara (JP); Yoshiyuki Kobayashi, Yamato-koriyama (JP); Masahiko Fujita, Nara (JP); Norichika Katsura, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/399,108

(22) Filed: Mar. 6, 2009

(65) Prior Publication Data

US 2009/0224472 A1 Sep. 10, 2009

(30) Foreign Application Priority Data

Mar. 10, 2008 (JP) ..... 2008-059734

(51) Int. Cl.
*B65H 31/00* (2006.01)

(52) U.S. Cl. ..... 271/207; 271/200

(58) Field of Classification Search ..... 271/200, 271/207, 314; 270/58.11, 58.12, 58.17, 58.27; 414/791.2

See application file for complete search history.

(56) References Cited

U.S. PATENT DOCUMENTS 3,608,876 A * 9/1971 Leaich et al. ..... 432/246
3,726,590 A * 4/1973 Kistner et al. ..... 355/100
4,480,825 A * 11/1984 Landa ..... 271/81
4,872,661 A * 10/1989 Knepper ..... 271/273
4,981,293 A * 1/1991 Yamashita et al. ..... 271/184
5,037,081 A * 8/1991 Engelhardt et al. ..... 271/207
5,040,779 A * 8/1991 Ogiri et al. ..... 271/109
5,044,624 A * 9/1991 Haus et al. ..... 271/274
5,513,839 A * 5/1996 Green ..... 270/58.07
6,533,265 B1 * 3/2003 Baldini ..... 271/207
6,799,013 B2 * 9/2004 Shin ..... 399/405
6,866,264 B2 * 3/2005 Dobrindt ..... 271/264
7,380,782 B2 * 6/2008 Lien ..... 271/109
7,520,504 B2 * 4/2009 Matsutomo et al. ..... 271/207
7,665,730 B2 * 2/2010 Funada ..... 271/250
7,731,174 B2 * 6/2010 Lee et al. ..... 271/109

(Continued)

FOREIGN PATENT DOCUMENTS

JP 2006-008370 1/2006
JP 2006-021843 1/2006

*Primary Examiner*—Stefanos Karmis
*Assistant Examiner*—Prasad V Gokhale
(74) *Attorney, Agent, or Firm*—Renner, Otto, Boisselle & Sklar, LLP

(57) ABSTRACT

A shifting mechanism includes a guide plate, a bearing, a rotating shaft, a delivery roller, and a bearing unit. The shifting mechanism delivers a sheet of paper along a delivery passage and offsets the sheet horizontally and perpendicularly to the passage while delivering it. The guide plate has an opening forming part of the delivery passage and an end hole formed through the front end of the plate horizontally and perpendicularly to the passage. The rotating shaft extends through the end hole. The delivery roller is fixed to the rotating shaft. The sheet passes through the nip between the delivery roller and the guide plate. The bearing unit extends movably through the end hole and includes a sleeve, which supports the rotating shaft horizontally and perpendicularly to the delivery passage. The bearing unit rotates the rotating shaft.

9 Claims, 9 Drawing Sheets

U.S. PATENT DOCUMENTS

2004/0156032 A1* 8/2004 Murakami et al. ..... 355/407
2004/0256787 A1* 12/2004 Wada et al. ..... 271/109
2005/0121848 A1* 6/2005 Kodama et al. ..... 270/58.12
2006/0181006 A1* 8/2006 Funada ..... 271/207
2007/0194523 A1* 8/2007 Yamaguchi ..... 271/314
2010/0007074 A1* 1/2010 Iguchi et al. ..... 270/58.08

* cited by examiner

PAPER DELIVERY MECHANISM AND APPARATUS FOR IMAGE FORMATION WITH A PAPER DELIVERY MECHANISM

CROSS REFERENCE

This Nonprovisional application claims priority under 35 U.S.C. §119(a) on Patent Application No. 2008-059734 filed in Japan on Mar. 10, 2008, the entire contents of which are hereby incorporated by reference.

BACKGROUND OF THE INVENTION

The present invention relates to an apparatus for electrophotographic image formation.

Some apparatuses for image formation are fitted with a paper delivery mechanism. In order to simply sort sheets of paper with an image formed on them, the paper delivery mechanism delivers them to two or more offset positions on a delivery tray.

For example, JP 2006-008370 A discloses a paper delivery mechanism including an offsetter, an offsetting driver, and a rotating driver. The offsetter includes roller pairs for delivering sheets of paper in one direction. The offsetting driver shifts the offsetter across this direction. The rotating driver drives a drive transmission mechanism, which rotates the roller pairs.

In recent years, it has been an important development problem to reduce the size of apparatus for image formation. Accordingly, it has been an important problem to reduce the size of paper delivery mechanisms for use in apparatus for image formation.

The drive transmission mechanism of the paper delivery mechanism disclosed in JP 2006-8370 A includes a gear train for transmitting torque from the rotating driver to the roller pairs, which shift across the delivery direction. The provision of the drive transmission mechanism is a problem with the reduction in the size of the delivery mechanism.

An object of the present invention is to provide a small and less costly paper delivery mechanism for delivering sheets of paper to two or more offset positions. Another object of the invention is to provide an apparatus for image formation fitted with such a mechanism.

SUMMARY OF THE INVENTION

A paper delivery mechanism according to the present invention includes an offset delivery unit and a drive transmission unit. The offset delivery unit delivers a sheet of paper along a delivery passage and offsets the sheet perpendicularly to the passage while delivering it. The offset delivery unit includes a shifter, a rotating shaft, and a delivery roller. The shifter shifts perpendicularly to the delivery passage. The shifter has an opening forming a part of the delivery passage. The shifter further has a first hole formed through one of its ends perpendicularly to the delivery passage. The rotating shaft extends through the first hole. The delivery roller is fixed to the rotating shaft. The sheet passes through the nip between the delivery roller and the passage part formed by the opening. The drive transmission unit rotates the rotating shaft and includes a cylindrical bearing.

The cylindrical bearing extends movably through the first hole of the shifter. The rotating shaft is supported by the cylindrical bearing shiftably across the delivery passage. This enables the rotating shaft to be supported by the cylindrical bearing shiftably across the delivery passage, without the bearing preventing the shifter from shifting perpendicularly to the passage. This also enables the cylindrical bearing to rotate the rotating shaft without preventing the shifter from shifting perpendicularly to the delivery passage. As a result, the cylindrical bearing can rotate the delivery roller without using a complicated mechanism.

The cylindrical bearing may have an axial groove formed inside it. The rotating shaft may have a radial protrusion, which engages with the groove so that the drive transmission unit can transmit torque to the shaft.

The shifter may further have a second hole formed through its other end in alignment with the first hole. The rotating shaft may extend through the second hole. This enables the rotating shaft to support both ends of the shifter.

DETAILED DESCRIPTION OF THE INVENTION

An apparatus for image formation 1 according to an embodiment of the present invention will be described below with reference to the accompanying drawings.

Figure 1:
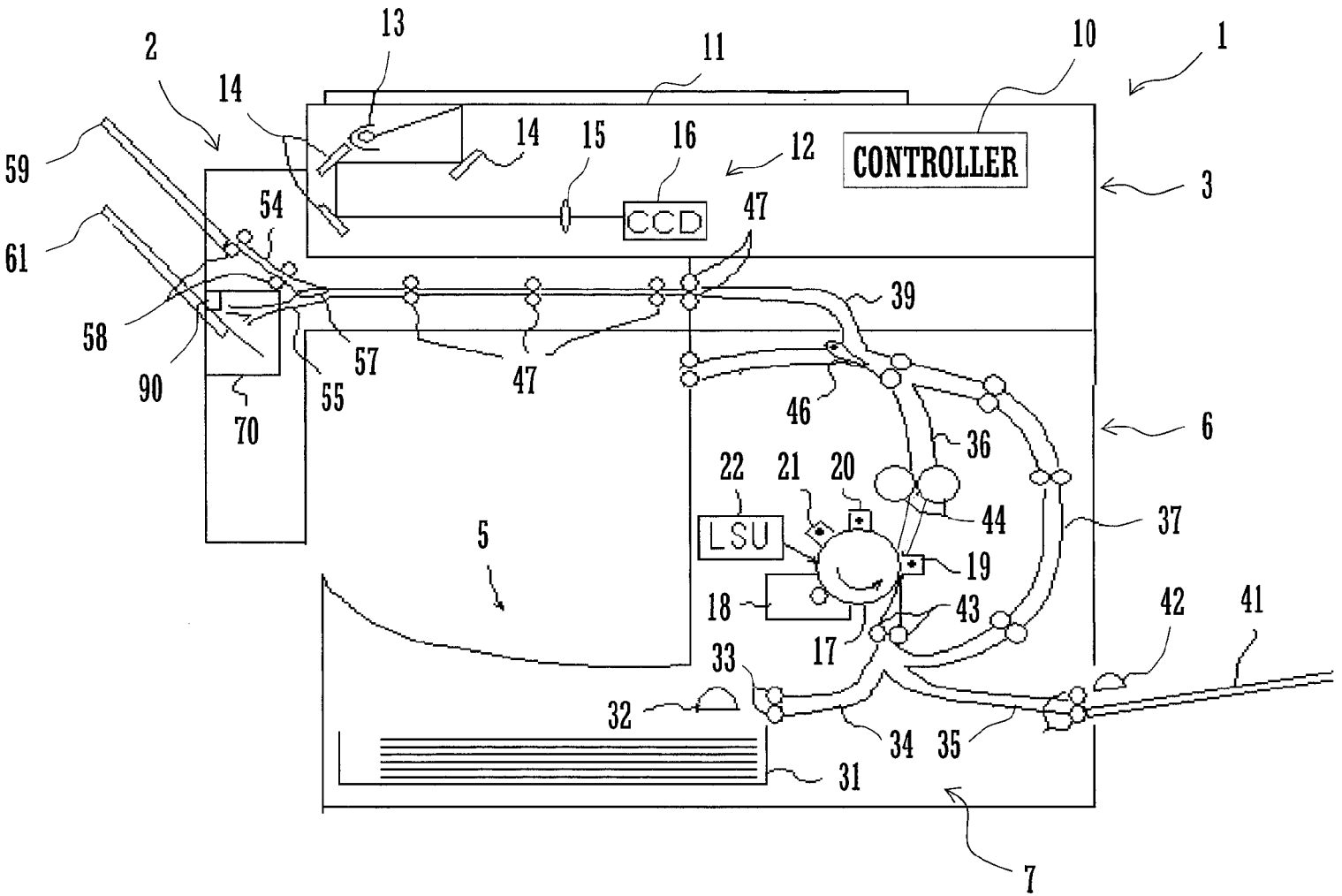
FIG. 1 is a schematic section of an apparatus for image formation according to an embodiment of the present invention.
Figure 2:
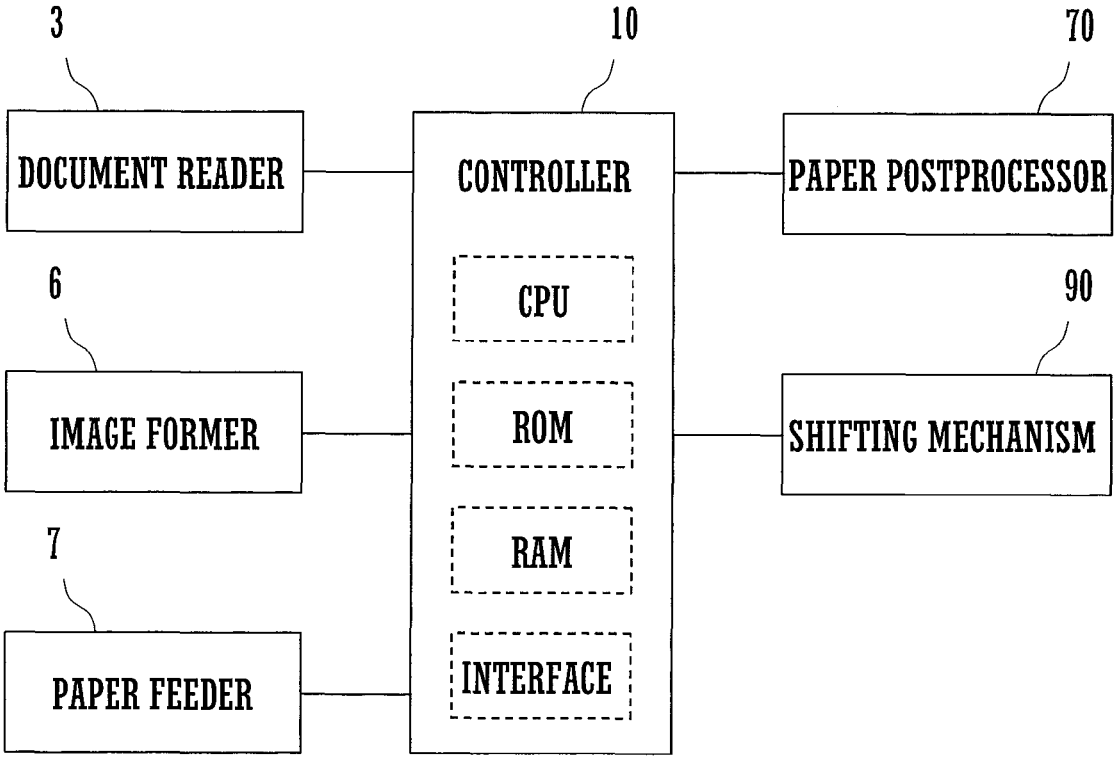
FIG. 2 is a block diagram showing the flow of the control performed by the controller of the apparatus.

FIG. 1 schematically shows the apparatus 1. FIG. 2 shows the flow of the control performed by the controller 10 of the apparatus 1.

The apparatus 1 consists essentially of a paper stacker 2, a document reader 3, trays 5, 59, and 61, an image former 6, and a paper feeder 7.

The paper stacker 2 includes a paper postprocessor 70 and a shifting mechanism (paper delivery mechanism) 90. The paper stacker 2 delivers sheets of paper to the trays 59 and 61.

The document reader 3 includes a document platform 11 of transparent glass and a scanner optical system 12, which is fitted under the platform 11. The optical system 12 includes a light source 13 for exposure, reflectors 14, an imaging lens 15, and a CCD 16 as a photoelectric conversion element. The light source 13 radiates light to the document placed on the platform 11. The light reflected by the document is then reflected by the reflector 14 and passes through the imaging lens 15 to the CCD 16.

The image former 6 includes a photosensitive drum 17, a developing unit 18, a transfer charger 19, a cleaning unit (not shown), a static eliminator 20, a main charger 21, and a laser scanning unit (LSU) 22.

The CCD 16 outputs image data in the form of an electric signal to the LSU 22. The LSU 22 irradiates the cylindrical surface of the photosensitive drum 17 with a laser beam based on the image data. The irradiation forms an electrostatic latent image on the drum surface. The developing unit 18 develops the latent image on the photosensitive drum 17 into a visible image with toner. The transfer charger 19 transfers the visible image on the photosensitive drum 17 to a sheet of paper. The cleaning unit eliminates the residual toner on the photosensitive drum 17. The static eliminator 20 eliminates the residual electric charge on the photosensitive drum 17. The main charger 21 charges the photosensitive drum 17 to a specified electric potential.

The paper feeder 7 includes a feed cassette 31, which holds sheets of paper. A feed roller 32 and a pair of parting rollers 33 are supported at the front end of the cassette 31.

A pair of registering rollers 43 is supported just under the photosensitive drum 17. The registering rollers 43 finely adjust the position of a sheet of paper and feed the sheet to the drum 17.

The fixing unit 44 is fitted above the photosensitive drum 17. The fixing unit 44 heats and fixes the visible image transferred to a sheet of paper by the transfer charger 19.

The apparatus 1 has paper paths 34-36, 39, 54, and 55. The fixing unit 44 is fitted on the path 36. Pairs of conveying rollers 47 are fitted on the path 39. A switching gate 57 is fitted on the downstream end of the path 39. The paper postprocessor 70 is fitted on the downstream end of the path 55.

A sheet of paper can be fed from the cassette 31 through the path 34 to the registering rollers 43. A sheet of paper can be fed from a hand feed tray 41 through the path 35 to the registering rollers 43. After the position etc. of the fed sheet are adjusted between the registering rollers 43, the sheet is fed to the nip between the photosensitive drum 17 and the transfer charger 19. The sheet passes upward from the nip through the path 36 and can be guided to the path 39 by a gate 46. The switching gate 57 switches the paths 54 and 55 according to the size of the sheet. The paper postprocessor 70 postprocesses the sheet passed through the path 55 and delivers the postprocessed sheet to the tray 61.

FIG. 2 shows the flow of the control performed by the controller 10.

The controller 10 includes a CPU, a ROM, and a RAM. The controller 10 controls the document reader 3, image former 6, paper feeder 7, paper postprocessor 70, and shifting mechanism 90. More specifically, the controller 10 controls the drive motors (not shown) for driving a delivery roller 83 and other rollers.

Figure 3:
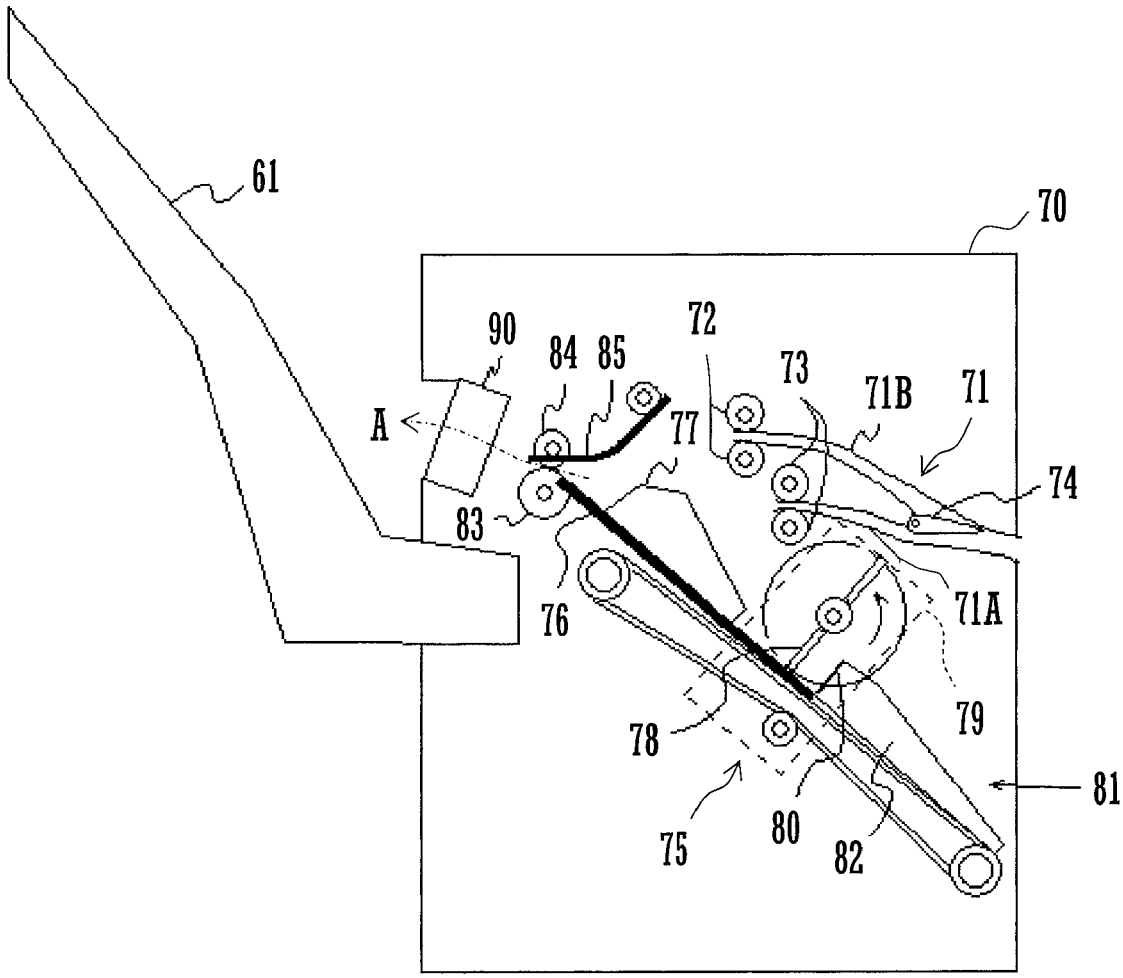
FIG. 3 is a schematic section of the paper postprocessor of the apparatus.

FIG. 3 schematically shows the paper postprocessor 70, which includes a postprocessing unit 75, a delivery unit 81, and the shifting mechanism 90.

The postprocessing unit 75 registers sheets of paper and binds the registered sheets by stapling them. The delivery unit 81 delivers the stapled sheets. The shifting mechanism 90 delivers sheets of paper to the tray 61.

The paper postprocessor 70 has a postprocessing path 71, to which a sheet of paper can be conveyed from the paper path 55. The postprocessing path 71 branches out into a main path 71A and a bypass 71B, which is positioned over the main path 71A. A switching gate 74 is fitted at the branch point of the postprocessing path 71 and switches the main path 71A and bypass 71B.

The postprocessing unit 75 includes a stapling plate 76, a side guide plate 77, a paddler 78, and a stapler 79. The delivery unit 81 includes a pusher 82, the delivery roller 83, and a driven roller 84.

The pusher 82 is supported below the stapling plate 76 movably in the directions in which this plate extends. The pusher 82 pushes to the delivery roller 83 the sheets bound on the stapling plate 76. This makes it possible to deliver the bound sheets from the stapling plate 76 to a delivery path A.

The stapling plate 76 is fitted with a stopper 80 on its lower end. The stopper 80 registers the lower ends of the sheets stacked on the stapling plate 76.

The delivery roller 83 delivers the stapled sheets along the delivery path A to the shifting mechanism 90. The rotating shaft of the delivery roller 83 is supported near the upper end of the stapling plate 76.

The rotating shaft of the driven roller 84 is supported on one end of an arm 85, the other end of which is supported rotatably by a frame of the apparatus 1. When a sheet of paper undergoes only offset processing without being stapled, the arm 85 pivots to bias the driven roller 84 against the delivery roller 83 so that the sheet can be delivered along the delivery path A through the nip between the rollers 83 and 84. This makes it possible to deliver the sheet from the postprocessing path 71 to the shifting mechanism 90, without passing the sheet through the delivery unit 81.

When the sheet passes through the nip between the delivery roller 83 and driven roller 84, these rollers detect the sheet by sensing the biasing force on it.

Figure 4:
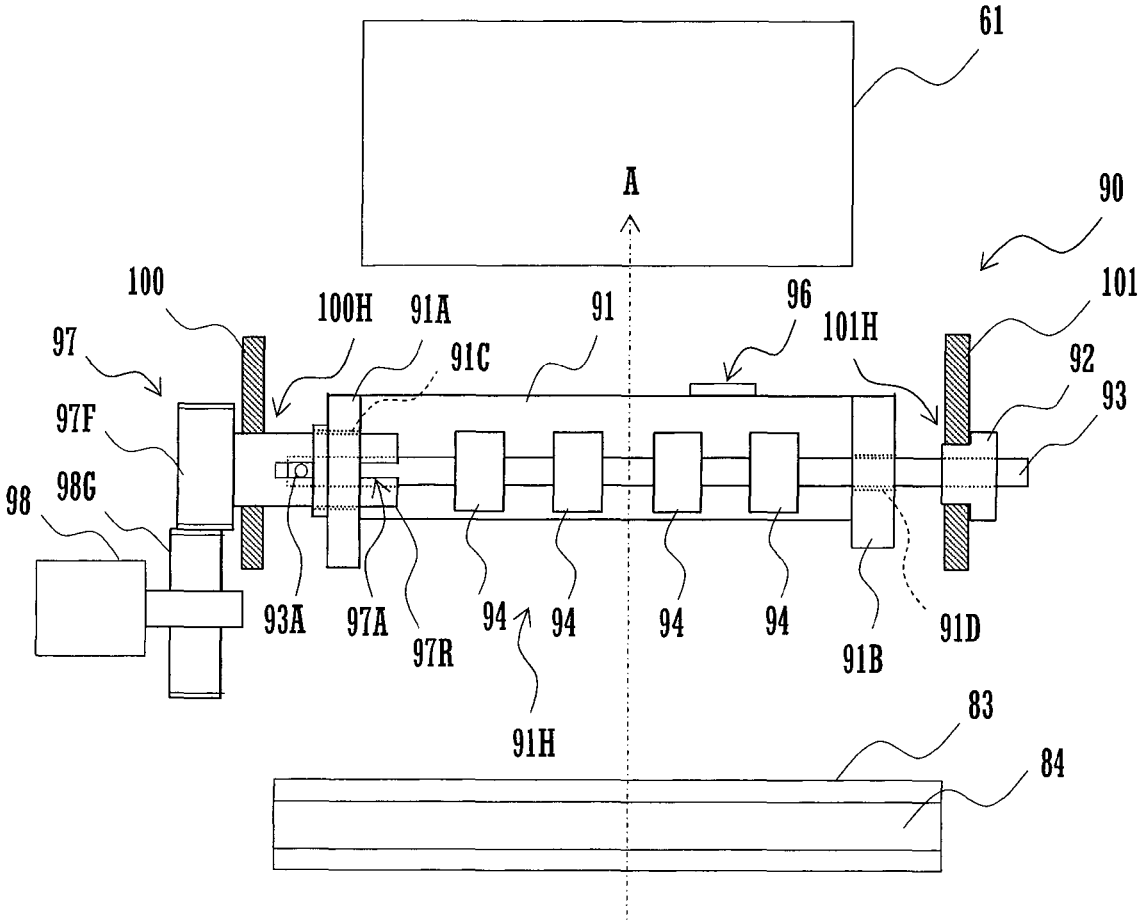
FIG. 4 is a schematic diagram showing the delivery path leading from a delivery roller and a driven roller of the apparatus to a tray of the apparatus.
Figure 5:
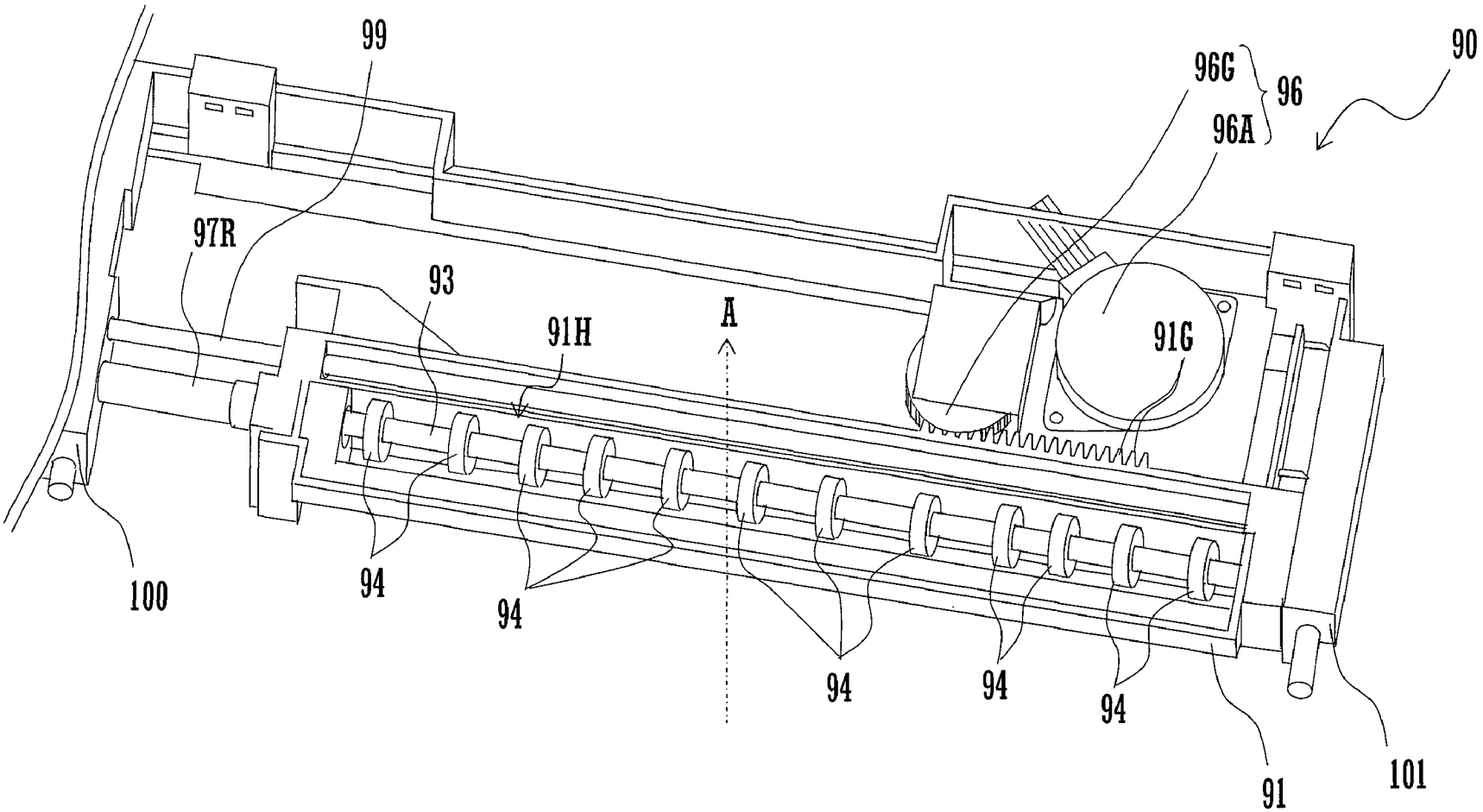
FIG. 5 is a perspective view of the shifting mechanism of the apparatus and parts around this mechanism as viewed from the tray.
Figure 6:
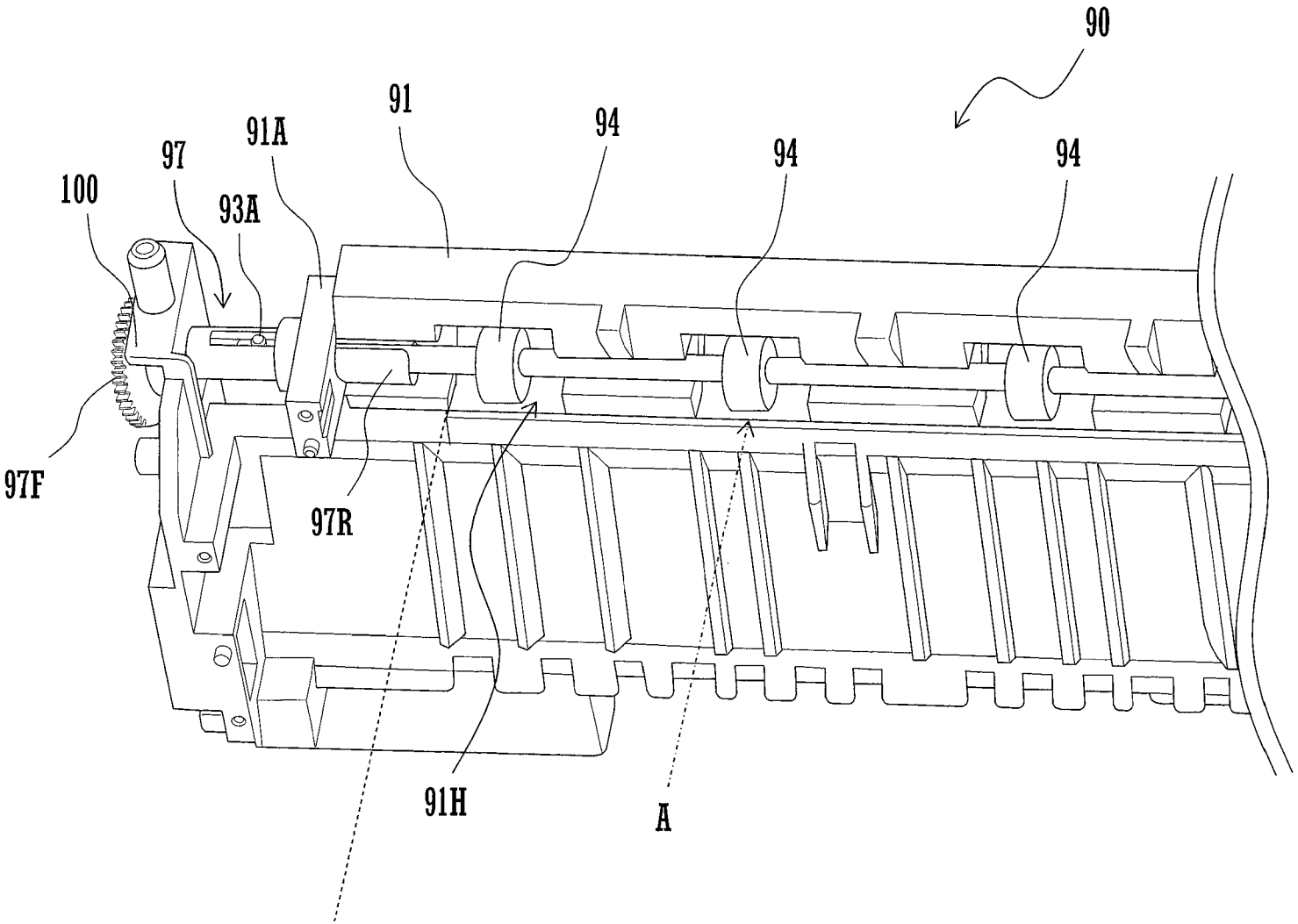
FIG. 6 is a perspective view of the shifting mechanism and parts around it as viewed from the delivery roller and the driven roller.

FIG. 4 schematically shows the shifting mechanism 90 and other parts around it. FIG. 5 shows the shifting mechanism 90 as viewed upstream along the delivery path A. FIG. 6 shows part of the shifting mechanism 90 as viewed downstream along the path A on the front side of the apparatus 1.

The shifting mechanism 90 includes a guide plate (shifter) 91, a bearing 92, a rotating shaft 93, delivery rollers 94, a drive unit 96, a bearing unit (drive transmission unit) 97, a drive motor 98, and a slide bar 99. The guide plate 91, rotating shaft 93, and delivery rollers 94 correspond to the offset delivery unit of the present invention.

The rotating shaft 93 and slide bar 99 extend horizontally across the delivery path A.

The guide plate 91 has a rectangular opening 91H formed through an upper portion of it. The bottom of the opening 91H forms part of the delivery passage through which the shifting mechanism 90 delivers a sheet of paper along the delivery path A. In FIG. 6, the broken line indicates one edge of the part of the delivery passage which is upstream from the plate 91. The plate 91 has protrusions protruding slightly along the delivery path A from its bottom, which forms part of the passage. The protrusions reduce the contact area between the delivery passage and the sheet passing through the passage. This enables the sheet to pass smoothly through the delivery passage.

The drive unit 96 is fitted under a rear end portion of the guide plate 91. The plate 91 has a front end hole (first hole) 91C formed through its front end 91A. The plate 91 has a rear end hole (second hole) 91D formed through its rear end 91B. The holes 91C and 91D are cylindrical and coaxial with each other, and their axes are parallel to the rotating shaft 93 and slide bar 99.

The slide bar 99 extends through the guide plate 91 below the opening 91H. The plate 91 is supported slidably along the bar 99.

The drive unit 96 is positioned just under the guide plate 91 and includes a drive motor 96A and a pinion 96G. The plate 91 has a rack 91G formed at its bottom. The motor 96A drives the pinion 96G, which is in mesh with the rack 91G so as to slide the plate 91 along the slide bar 99.

The delivery rollers 94 are fixed to the rotating shaft 93. The guide plate 91 has grooves formed along the delivery path A at the bottom (delivery passage) of the opening 91H. Each delivery roller 94 is positioned in one of the grooves. The delivery rollers 94 deliver a sheet of paper along the delivery path A through the nips each of which is formed between one of these rollers and the delivery passage.

In FIG. 4, only four delivery rollers 94 are shown for simplification. Actually, as shown in FIG. 5, twelve delivery rollers 94 are fixed to the rotating shaft 93.

The apparatus 1 includes a front frame 100, which has a hole 100H formed through it. The bearing unit 97 is supported through the frame hole 100H. The bearing unit 97 consists of a pinion 97F and a cylindrical sleeve (first bearing) 97R. The pinion 97F is fixed to the front end of the sleeve 97R.

The apparatus 1 further includes a rear frame 101, which has a hole 101H formed through it in alignment with the frame hole 100H. The bearing 92 is in engagement with the frame hole 101H.

The rotating shaft 93 extends through the holes 100H, 91C, and 91D and the bearing 92 and is supported slidably in parallel to the slide bar 99. This makes it possible to support both ends of the guide plate 91 slidably along the bar 99.

Figure 7:
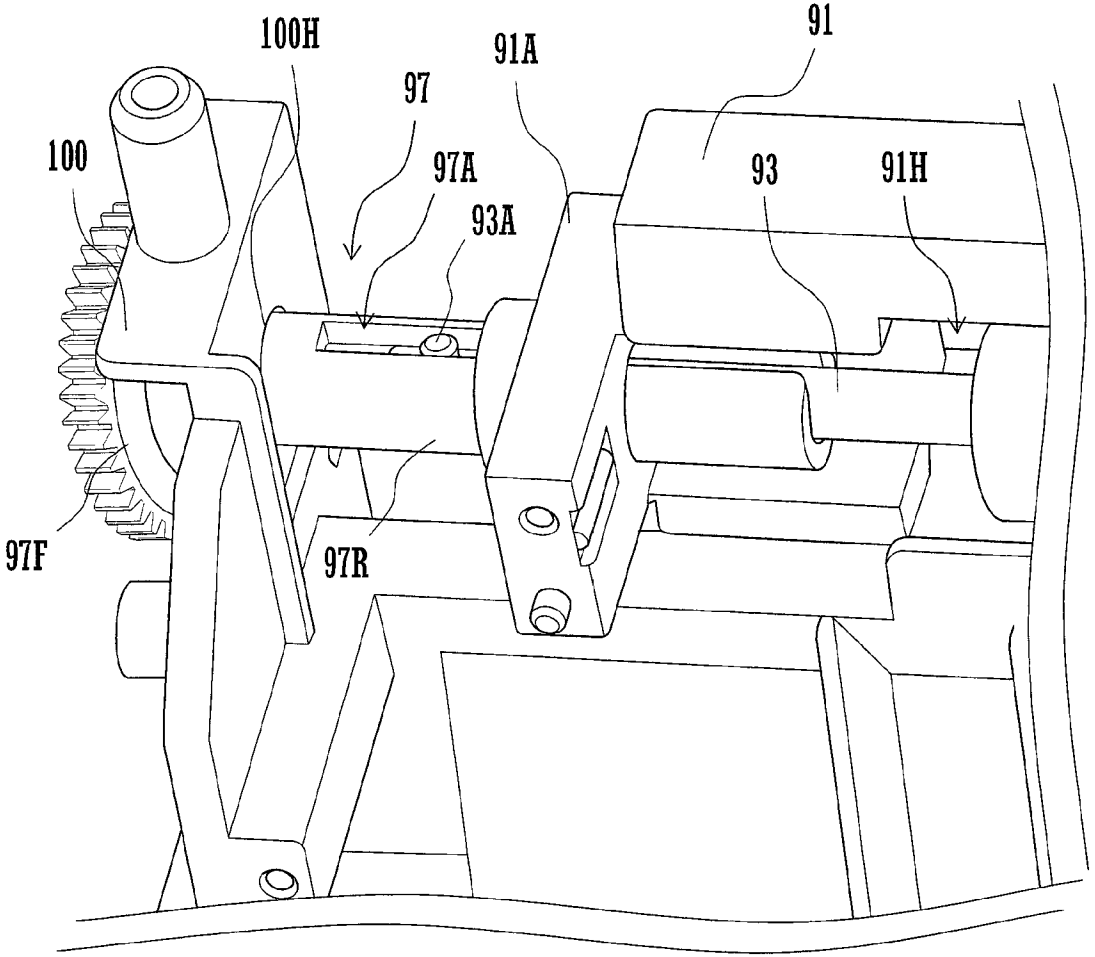
FIG. 7 is an enlarged perspective view of the bearing unit of the apparatus and parts around this unit.

FIG. 7 shows the bearing unit 97 and parts around it.

The pinion 97F is positioned in front of the front frame 100 and larger in outer diameter than the sleeve 97R. The pinion 97F is in mesh with a pinion 98G, which the drive motor 98 drives.

The sleeve 97R is supported through the frame hole 100H. The rear end of the sleeve 97R is open. The sleeve 97R has an axial slit 97A. The rotating shaft 93 extends loosely through the sleeve 97R.

The rotating shaft 93 has a radial protrusion 93A formed on its cylindrical surface near its front end. The protrusion 93A is in slidable engagement with the slit 97A so that the bearing unit 97 can transmit torque to the shaft 93. This makes it possible to rotate the shaft 93 without providing a complicated transmission mechanism including gears. As a result, the shifting mechanism 90 makes it possible to restrain the manufacturing costs from increasing, and to reduce the size of the transmission mechanism of the apparatus 1.

The axial slit 97A of the sleeve 97R might be replaced by an axial groove formed on the inside of the sleeve.

The radial protrusion 93A of the rotating shaft 93 is shorter than the depth of the slit 97A so as to be kept out of contact with the guide plate 91 when this plate shifts forward.

Figure 8A:
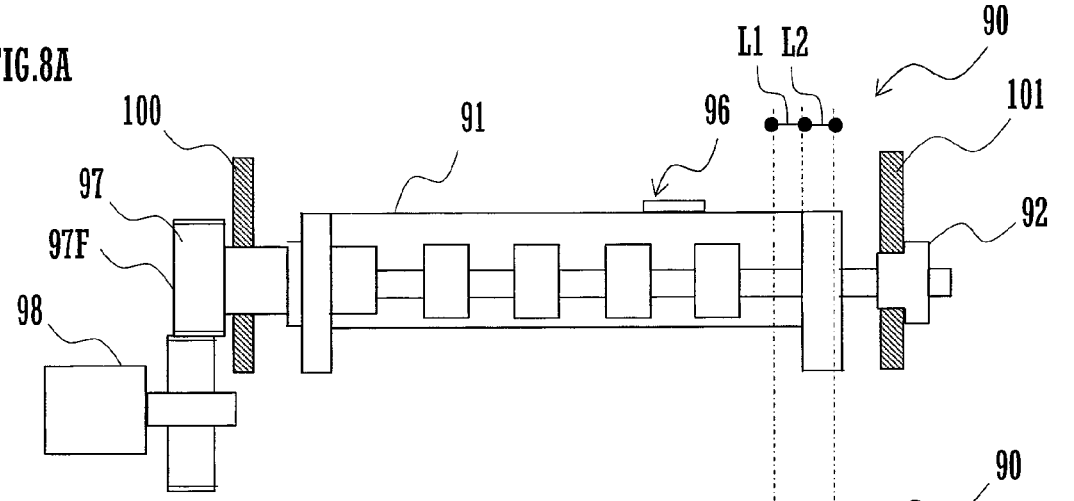
FIG. 8A is a schematic diagram of the shifting mechanism, showing its guide plate held in the initial position.
Figure 8B:
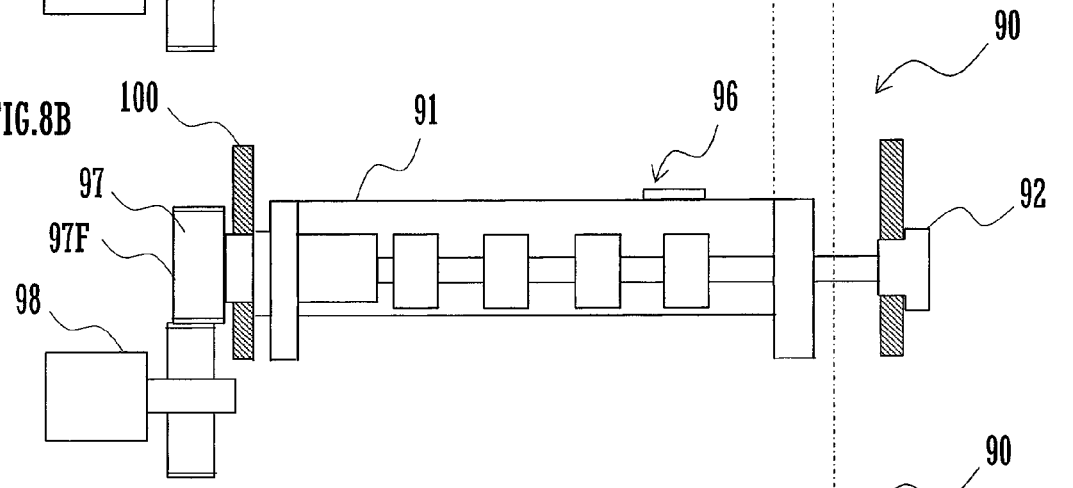
FIG. 8B is a schematic diagram of the shifting mechanism, showing the guide plate shifted to the forward offset position.
Figure 8C:
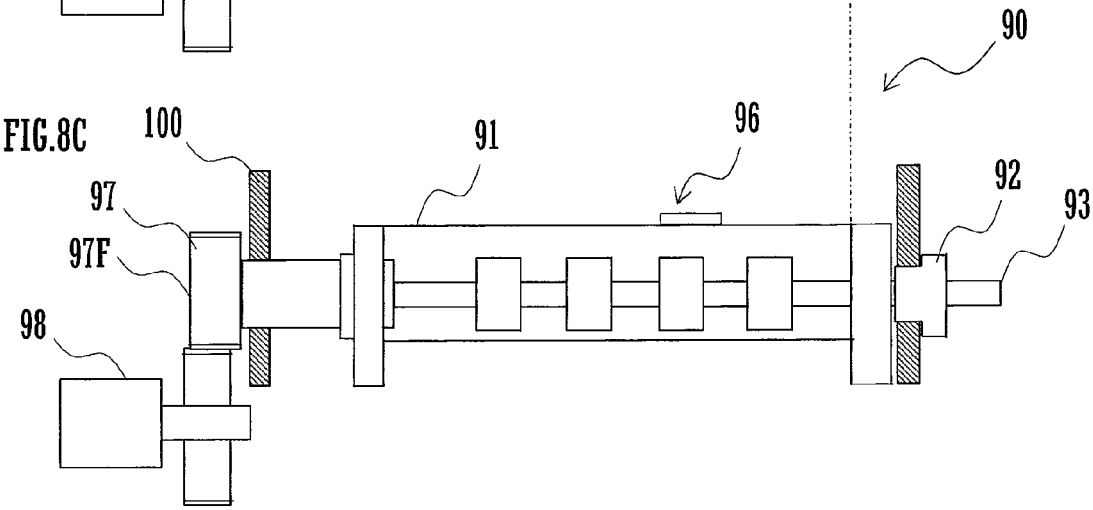
FIG. 8C is a schematic diagram of the shifting mechanism, showing the guide plate shifted to the backward offset position.

FIG. 8A-8C show how the guide plate 91 shifts along the slide bar 99. FIG. 8A shows the plate 91 in its initial position. FIG. 8B shows the plate 91 in its forward offset position. FIG. 8C shows the plate 91 in its backward offset position.

Figure 9:
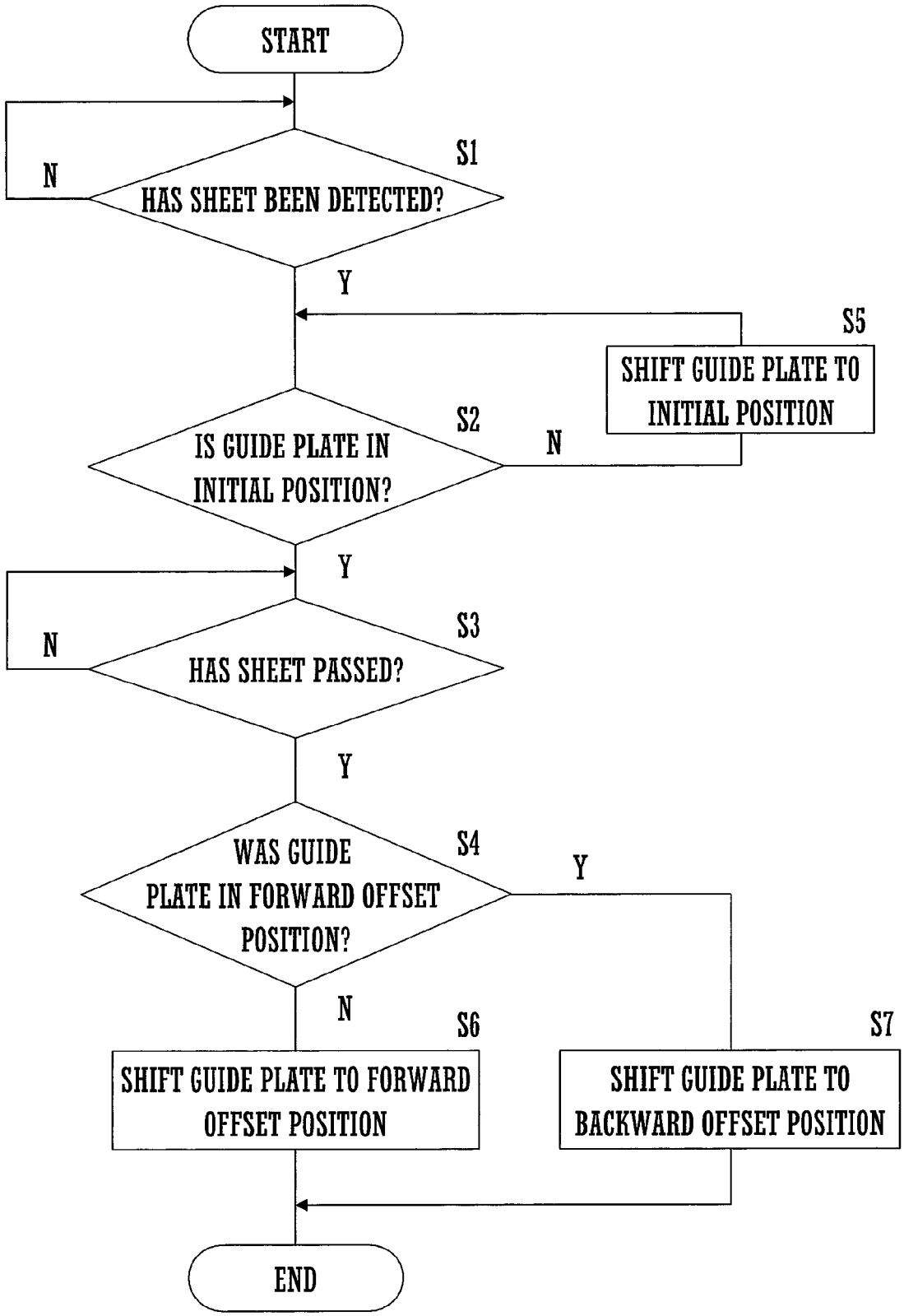
FIG. 9 is a flowchart of the delivery control of the shifting mechanism, which is performed by the controller.

FIG. 9 shows the flow of the delivery control of the shifting mechanism 90, which is performed by the controller 10.

When the leading end of a sheet of paper passing along the delivery path A has just passed through the nip between the delivery roller 83 and the driven roller 84, the controller 10 detects this end (S1). Then, the controller 10 so activates the drive unit 96 as to shift the guide plate 91 along the slide bar 99 to the initial position (FIG. 8A), and also activates the drive motor 98 to rotate the delivery rollers 94 (S2, S5).

When the trailing end of the sheet has just passed through the nip between the rollers 83 and 84, the controller 10 detects this end (S3). Then, the controller 10 activates the drive unit 96 to shift the guide plate 91 in either direction along the slide bar 99 (S4, S6, S7). Specifically, if the plate 91 has been in the backward offset position (FIG. 8C) for the preceding sheet, the drive unit 96 shifts the plate 91 to the forward offset position (FIG. 8B) by sliding it forward by a distance L1 from the initial position (FIG. 8A) (S4, S6). Likewise, if the plate 91 has been in the forward offset position for the preceding sheet, the drive unit 96 shifts the plate 91 to the backward offset position by sliding it backward by a distance L2 from the initial position (S4, S7).

At each of steps S6 and S7, the controller 10 activates the drive motor 98 to rotate the delivery rollers 94 for the time which they take to deliver the sheet to the tray 61. Then, the controller 10 stops the motor 98, ending the delivery control of the shifting mechanism 90.

The guide plate 91 has shallow grooves formed along the delivery path A. Each delivery roller 94 is in contact with the bottom of one of the grooves. The sides of the grooves restrict the movement of the delivery rollers 94 within a specified range along the plate 91 when this plate shifts along the slide bar 99. This prevents the rotating shaft 93 from falling from the sleeve 97R when the plate 91 shifts along the bar 99.

The rear end of the sleeve slit 97A is open, and each delivery roller 94 is positioned in the associated groove of the guide plate 91. The rear end of the slit 97A might be narrower than the diameter or thickness of the shaft protrusion 93A so that the slit 97A could restrict the movement of the protrusion 93A along the sleeve 97R.

The rotating shaft 93 supports the guide plate 91 by extending through its end holes 91C and 91D. If the rigidity of the plate 91 were high, the shaft 93 might support only the front end of the plate 91 by extending through only the front end hole 91C.

The sleeve slit 97A transmits torque to the shaft protrusion 93A. Alternatively, the sleeve 97R might have a protrusion formed on its inside, and the rotating shaft 93 might have an axial groove for engagement with this protrusion.

The sleeve 97R has an inner cylindrical surface, and its rear end is open. The rotating shaft 93 is circular in radial section. A front end portion of the shaft 93 can slide axially in the sleeve 97R. Alternatively, the front end portion of the shaft 93 might be polygonal in radial section, and the inner surface of the sleeve 97R might be so shaped that the polygonal shaft portion could slide axially in the sleeve 97R. In this case as well, the sleeve 97R could transmit torque to the shaft 93.

The shifting mechanism 90 is fitted to the apparatus for image formation 1. If the shifting mechanism 90 were fitted to a sorting conveyor or the like, the shifting mechanism 90 could have advantages similar to those which it has with the apparatus 1.

Each delivery roller 94 is positioned at the associated groove of the guide plate 91. Alternatively, the plate 91 might be fitted with driven rollers, each of which could engage with one of the delivery rollers 94. A sheet of paper could be delivered through the nips each of which is formed between one of the driven rollers and the associated delivery roller 94. This could bring advantages similar to those brought by the shifting mechanism 90. Each of the driven rollers might be supported rotatably by a member for biasing it vertically against the associated roller 94. This would make it possible to convey stacked sheets of paper through the roller nips, with the driven rollers shifted downward.

FIGS. 1 and 3-8 are mimetic diagrams showing the embodiment. In these figures, some parts are shown in section without being hatched.

The present invention being thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A paper delivery mechanism comprising:

an offset delivery unit for delivering a sheet of paper along a delivery passage and offsetting the sheet perpendicularly to the passage while delivering the sheet;

the offset delivery unit including a shifter, a rotating shaft, and a delivery roller, the shifter being shiftable perpendicularly to the delivery passage, the shifter having an opening forming a part of the delivery passage, the shifter further having a first hole formed through one end thereof perpendicularly to the delivery passage, the rotating shaft extending through the first hole, the delivery roller being fixed to the rotating shaft, the delivery roller and the part of the delivery passage formed by the opening forming a nip therebetween through which the sheet can pass; and a drive transmission unit for rotating the rotating shaft;

wherein the drive transmission unit includes a cylindrical bearing extending movably through the first hole of the shifter, the rotating shaft being supported by the cylindrical bearing shiftably across the delivery passage, and the cylindrical bearing being configured to transmit torque to the rotating shaft while the rotating shaft is shifted in an axial direction.

2. A paper delivery mechanism as claimed in claim 1, wherein the cylindrical bearing has an axial groove formed thereinside, and wherein the rotating shaft has a radial protrusion engaging with the groove.

3. A paper delivery mechanism as claimed in claim 2, wherein the shifter further has a second hole formed through the other end thereof in alignment with the first hole, and wherein the rotating shaft extends rotatably through the second hole.

4. An apparatus for image formation comprising:

an image former for forming an image on a sheet of paper;

a delivery tray; and a paper delivery mechanism as claimed in claim 3;

the paper delivery mechanism being adapted to deliver to the delivery tray the sheet conveyed from the image former.

5. An apparatus for image formation comprising:

an image former for forming an image on a sheet of paper;

a delivery tray; and a paper delivery mechanism as claimed in claim 2;

the paper delivery mechanism being adapted to deliver to the delivery tray the sheet conveyed from the image former.

6. A paper delivery mechanism as claimed in claim 1, wherein the shifter further has a second hole formed through the other end thereof in alignment with the first hole, and wherein the rotating shaft extends through the second hole.

7. An apparatus for image formation comprising:

an image former for forming an image on a sheet of paper;

a delivery tray; and a paper delivery mechanism as claimed in claim 6;

the paper delivery mechanism being adapted to deliver to the delivery tray the sheet conveyed from the image former.

8. An apparatus for image formation comprising:

an image former for forming an image on a sheet of paper;

a delivery tray; and a paper delivery mechanism as claimed in claim 1;

the paper delivery mechanism being adapted to deliver to the delivery tray the sheet conveyed from the image former.

9. A paper delivery mechanism as claimed in claim 1, wherein the cylindrical bearing has an axial slit formed thereinside, and wherein the rotating shaft has a radial protrusion engaging with the slit.

* * * * *